US005647731A

United States Patent [19]

Onozawa

[11] Patent Number: 5,647,731

[45] Date of Patent: Jul. 15, 1997

[54] AIR COMPRESSOR

[75] Inventor: Motoyuki Onozawa, Higashimatsuyama, Japan

[73] Assignee: Zexel Corporation, Tokyo, Japan

[21] Appl. No.: 431,030

[22] Filed: Apr. 28, 1995

[30] Foreign Application Priority Data

Apr. 28, 1994 [JP] Japan ..... 6-114179

[51] Int. Cl.[6] ..... F04B 49/02

[52] U.S. Cl. ..... 417/295; 417/440; 417/557

[58] Field of Search ..... 417/295, 364, 417/440, 557, 297, 298

[56] References Cited

U.S. PATENT DOCUMENTS

| | | | |
|---|---|---|---|
| 3,204,857 | 9/1965 | Weller | 417/557 |
| 3,578,883 | 5/1971 | Cheney | 417/295 |
| 4,229,146 | 10/1980 | Errett | 417/281 |
| 4,370,103 | 1/1983 | Tripp | 417/298 |
| 4,432,698 | 2/1984 | Shirakuma et al. | 417/298 |
| 4,993,922 | 2/1991 | Lauterbach et al. | 417/279 |
| 5,364,240 | 11/1994 | Salecker | 417/427 |
| 5,503,537 | 4/1996 | Schlossarczyk et al. | 417/296 |

FOREIGN PATENT DOCUMENTS 2-32875 9/1990 Japan .

*Primary Examiner*—Timothy Thorpe
*Assistant Examiner*—Peter G. Korytnyk
*Attorney, Agent, or Firm*—Wenderoth, Lind & Ponack

[57] ABSTRACT

An air compressor in which oil loss due to the pressure in the cylinder becoming negative during an unload can be prevented, thereby protecting an outlet-side unloader valve. An air leak hole with a specific ventilating resistance is formed between a valve body and a valve seat of an intake-side unloader valve when the intake-side unloader valve is closed. Also, a valve seat portion is provided, which cuts off a sliding portion of the outlet-side unloader valve from the outlet passage when the outlet-side unloader valve is opened.

15 Claims, 6 Drawing Sheets

AIR COMPRESSOR

BACKGROUND OF THE INVENTION

1. Field of the Invention

The present invention relates to an air compressor for use in an air piping system through which compressed air is supplied to air brakes, air suspension systems, automatic doors and the like.

2. Description of the Related Art

Generally speaking, an air piping system is constituted of an air compressor 1 and an air tank 2 linked by piping via an air dryer 3 and a check valve 4, as shown in FIG. 6. In the system, air is taken in and compressed by the air compressor 1, temporarily stored in the air tank 2 after being dehumidified with a drying agent in the air dryer 3 and then supplied to air brakes or the like via piping that is connected to the outlet-side of the air tank. Also connected to the air tank 2 via the piping is a governor 5, the exit side of which communicates with the unloader valves on the intake side and the outlet side of the air compressor 1 so that, when the pressure in the air tank 2 rises to a specific level, the governor 5 enters the open state, to operate the unloader valves, thereby setting the air compressor 1 in a decompression state (unload state). Moreover, when the pressure in the air tank 2 drops under a specific level, the governor 5 enters the closed state and is reset to its initial state, to start the compression function of the air compressor 1.

The air compressor disclosed in Japanese Unexamined Patent Publication No. H2-32875 is an example of this type of air compressor. This air compressor features a residual pressure forming valve which blocks off the outlet-side passage when the unload valve provided in the intake-side passage is closed, in order to suppress, as much as possible, any negative pressure in the cylinder during an unload and to prevent oil from being drawn up into the cylinder. According to this invention, with the residual pressure forming valve blocking off the outlet passage, discharge of the air inside the cylinder during an up-stroke of the piston is inhibited, to maintain the pressure in the cylinder at a high level, and since, even when the piston enters the down-stoke, the pressure in the cylinder does not become extremely negative, preventing the pressure in the cylinder from becoming negative.

However, in the example quoted above, since there is no air supply to the cylinder during an unload, if the unload time is long, the air in the cylinder overflows into the crank chamber through the gap between the cylinder and the piston, reducing the pressure in the cylinder, which may then become negative.

Furthermore, since the air that is thus released contains oil, carbon and the like in the cylinder, there is a likelihood of these substances, i.e., oil, carbon and the like, adhering to the sliding area of the residual pressure forming valve (outlet-side unloader valve), which may cause operational failure. Also, there is a likelihood of the valve body making a fluttering movement due to the pressure wave of the outlet pressure of the outlet air and becoming worn.

SUMMARY OF THE INVENTION

The object of the present invention is to provide an air compressor in which pressure in the cylinder does not become negative during an unload, so that loss of oil can be prevented and, at the same time, the outlet-side unloader valve can be protected.

Accordingly, in order to prevent the pressure in the cylinder from becoming negative during an unload, the first mode of the present invention is an air compressor having an intake passage for taking air into the cylinder via an intake valve through reciprocal movement of a piston, an outlet passage for discharging compressed air to the air tank side via an outlet valve, an intake-side unloader valve for blocking off the intake passage when the pressure in the air tank exceeds a specific level and an outlet-side unloader valve for blocking off the outlet passage. The air compressor is further provided with an air leak hole having a specific level of ventilating resistance. The air leak hole is formed between the valve body and the valve seat of the intake-side unloader valve when the intake-side unloader valve is closed.

Thus, due to the air leak hole, which has a specific level of ventilating resistance between the valve body and the valve seat of the intake-side unloader valve when the intake-side unloader valve is closed, a specific quantity of air is taken in through the air leak hole during the piston down-stroke and compressed during the piston up-stroke, to maintain the pressure in the cylinder at a specific level, thereby preventing it from becoming negative. Note that since the air that blows by through the gap between the cylinder and the piston is constantly replenished with air taken in through the air leak hole, the pressure in the cylinder is maintained at a specific level even when the unload time is long.

In addition, in a second mode of the present invention, in order to protect the outlet-side unloader valve, is an air compressor including an intake passage for taking air into the cylinder via an intake valve through the reciprocal movement of a piston, an outlet passage for discharging compressed air to the air tank side via an outlet valve, an intake-side unloader valve for blocking off the intake passage when the air in the air tank exceeds a specific level and an outlet-side unloader valve for blocking off the outlet-side passage. It is further provided with a seat portion for accommodating the valve body of the outlet-side unloader valve to cut off the sliding portion of the outlet-side unloader valve from the outlet passage when the outlet-side unloader valve is open.

Thus, due to the seat portion for blocking off the sliding portion of the unloader valve from the outlet passage when the outlet-side unloader valve is open, the outlet air is prevented from entering the sliding portion of the unloader valve and, at the same time, since the valve body is housed and held in the seat portion, the valve body does not vibrate and become worn due to the pressure wave of the outlet air.

Furthermore, according to a third mode of the present invention, in order to achieve the goals described earlier all at once, is an air compressor including an intake passage for taking air into the cylinder via an intake valve through the reciprocal movement of a piston, an outlet passage for discharging compressed air to the air tank side via an outlet valve, an intake-side unloader valve for blocking off the intake passage when the pressure in the air tank exceeds a specific level and an out-let-side unloader valve for blocking off the outlet passage. It is further provided with an air leak hole formed between the valve body and the valve seat of the intake-side unloader valve when the intake-side unloader valve is closed that has a specific level of ventilating resistance, and a seat portion for accommodating the valve body of the outlet-side unloader valve, to cut off the sliding portion of the unloader valve from the outlet passage when the outlet-side unloader valve is open.

Consequently, since it is provided with the features of the first and second modes of the present invention, the goals described earlier can be achieved all at once.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate a preferred embodiment. In the drawings.

DETAILED DESCRIPTION OF THE PREFERRED EMBODIMENT

Figure 1:
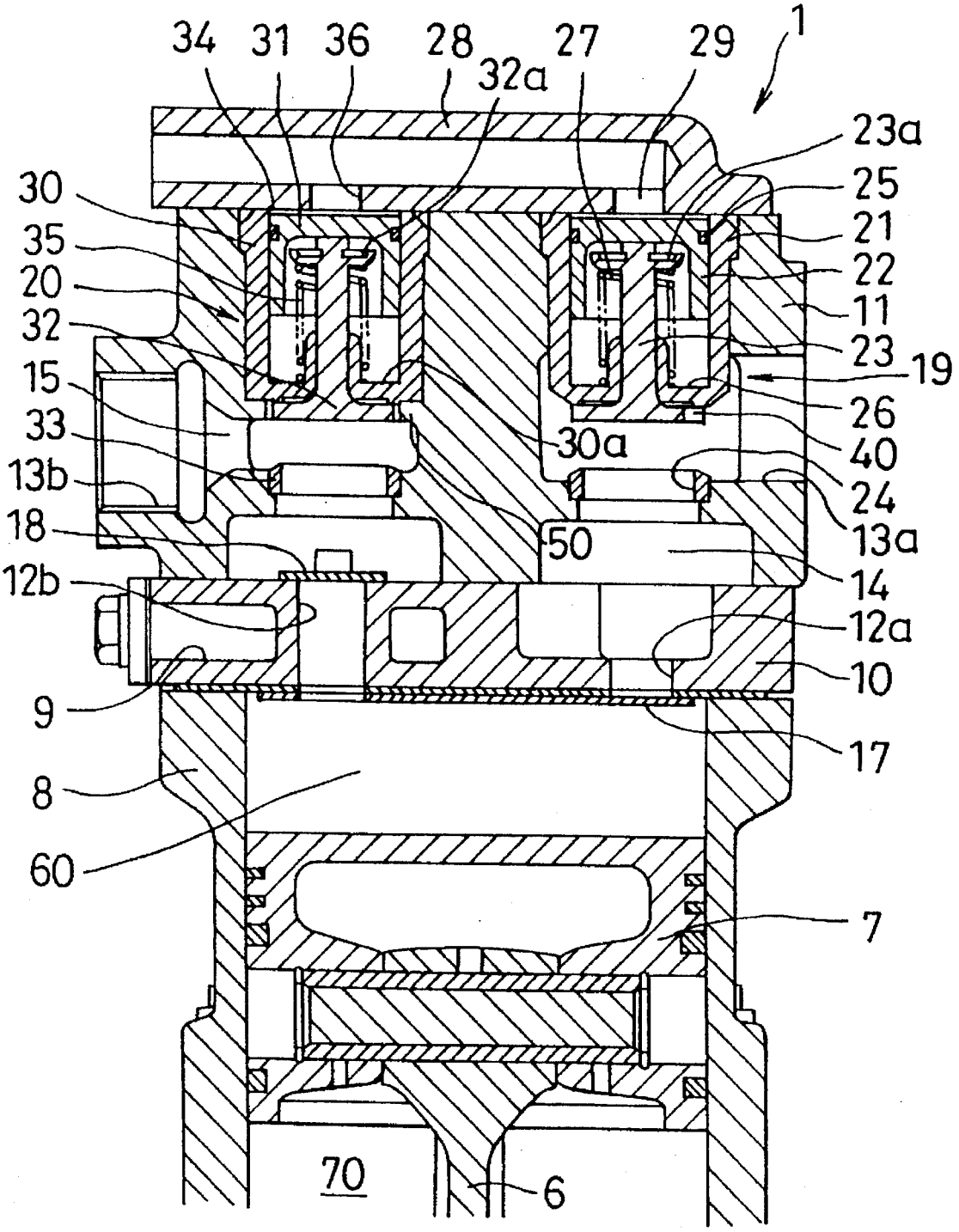
FIG. 1 is a cross section showing the structure of the air compressor according to an embodiment of the present invention.

The following is an explanation of an embodiment of the present invention with reference to the drawings.

An air compressor 1 shown in FIGS. 1–5 is directly linked with an engine (not shown) via a timing gear and it is constantly rotated as long as the engine is driven. A piston 7 reciprocates in the cylinder 8 via a connecting rod 6 which is provided inside a crank chamber 70 to change the volumetric capacity of a compression space 60.

In the upper portion of the cylinder 8, an intermediate member 10 is provided, in which a cooling water passage 9 is formed. A cylinder head 11 is secured above the intermediate member 10. In the intermediate member 10, through holes 12*a* and 12*b* are formed. At an open end of the through hole 12*a* on the cylinder side, an intake valve 17 is provided and at the open end of the through hole 12*b* on the cylinder head side an outlet valve 18 is provided. In addition, the cylinder head 11 is provided with a communicating hole 13*a* which extends from one side surface of the cylinder head to a. Also, communicating hole 13*b* extends from the other side surface of the cylinder head to the bottom surface. The communicating hole 13*a* is connected with the through hole 12*a* to constitute an intake passage 14 and the communicating hole 13*b* is connected with the through hole 12*b* to constitute an outlet passage 15. An intake-side unloader valve 19 is provided in the intake passage 14 for opening and closing the intake passage 14 and an outlet-side unloader valve 20 is provided in the outlet passage 15 for opening and closing the outlet passage 15.

The intake-side unloader valve 19 includes an unload piston 22, fitted inside a holder 21, which is mounted in the upper portion of the cylinder head 11 in such a manner that it can slide freely. A valve body 23 is provided and is in contact with the unload piston 22 and a valve seat 24 is provided on the intake passage 14 as a part of the cylinder head 11 which faces opposite the valve body 23. In addition, the valve body 23 is provided with an air leak hole 40 formed as a notch of a specific size so that when the valve body 23 is seated in the valve seat 24, the intake passage 14 is opened with a specific level of ventilating resistance.

Figure 6:
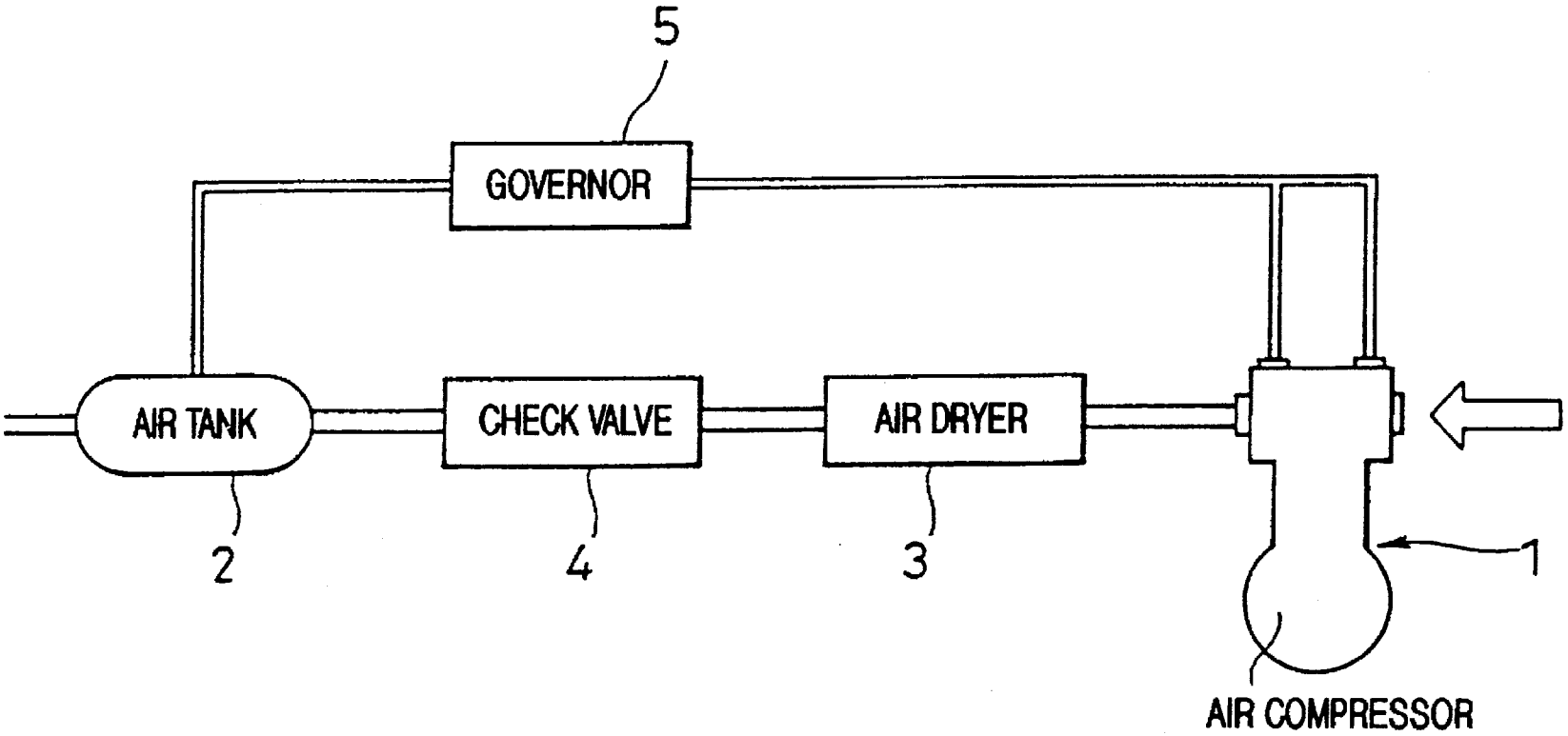
FIG. 6 PRIOR ART
FIG. 6 is a block diagram of an air piping system in which the air compressor is used.

Moreover, the air tightness between the unload piston 22 and the holder 21 is maintained with an O-ring 25 provided around the unload piston 22, and a spring 27 is provided between a spring receptacle 23*a* formed at the base portion of the valve body 23 and a spring receptacle 26 provided under the holder 21. This spring 27 applies a constant force to the unload piston 2 in the direction which moves it away from the valve seat 24. The piping 28 which communicates with the governor 5 shown in FIG. 6 is connected to the upper end of the holder 21 and compressed air from the air tank 2 is supplied to the upper end of the unload piston 22 through a hole 29 formed in the piping 28 so that the unload piston 22 can be pressed down against the resistance or bias of the spring 27.

In the outlet-side unloader valve 20, an unload piston 31 is fitted inside a holder 30 which is mounted in the cylinder head 11 in such a manner that it slides freely. A valve body 32, which is in contact with the unload piston 31, is seated in a valve seat 33, provided on the outlet passage 15 as part of the cylinder head 11 facing opposite the valve body 32, to block off the outlet passage 15.

The air tightness between this unload piston 31 and the holder 30 is also maintained with an 0-ring 34 which is provided at the holder 30. A spring 35 is provided between a spring receptacle 32*a*, formed in the base portion of the valve body 32, and a spring receptacle 30*a* provided under the holder 30. This spring 35 applies a constant force to the unload piston 31 in a direction which moves it away from the valve seat 33. The piping 28 which communicates with the governor 5 shown in FIG. 6 is connected to the upper end of the holder 30 and compressed air from the air tank 2 is supplied to the upper end of the unload piston 31 through a hole 36 formed in the piping 28, so that the unload piston 31 can be pressed down against the resistance or bias of the spring 35.

The valve body 32 is housed in a seat portion 50 which is formed as part of the cylinder head 11 extending toward the inside while maintaining a specific diameter in the vicinity of the lower end of the holder 30 at a position at which the unload piston 31 is biased upwardly by the spring 35, i.e., at the so-called load position and since the valve body 32 is seated in the lower end portion of the holder 30, it shuts off the sliding portion of the outlet-side unloader valve 20, which includes parts such as the unload piston 31 and the like, from the outlet passage 15.

Figure 2:
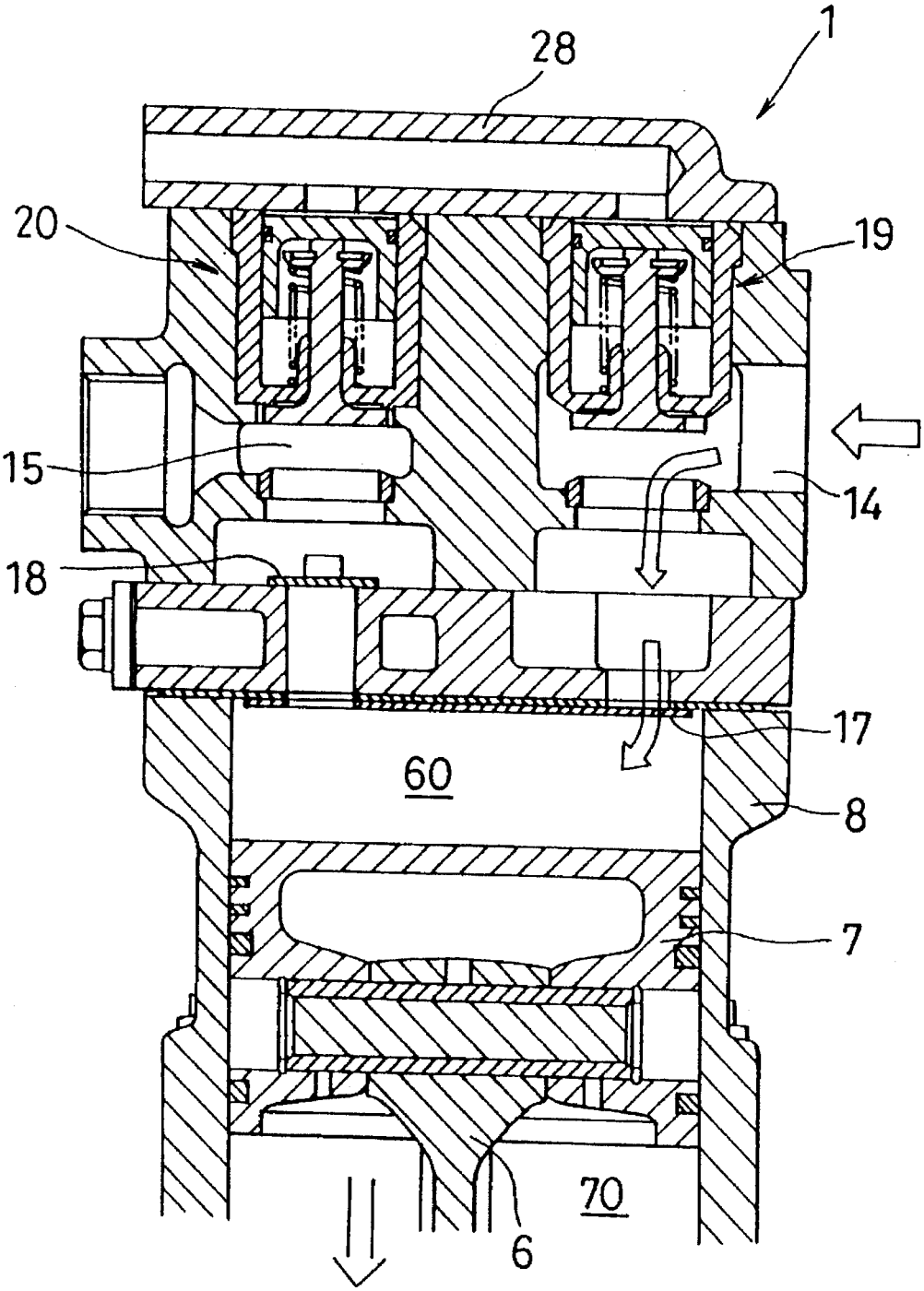
FIG. 2 is a cross section illustrating the process of the piston down-stroke during a load of the air compressor shown in FIG. 1.
Figure 3:
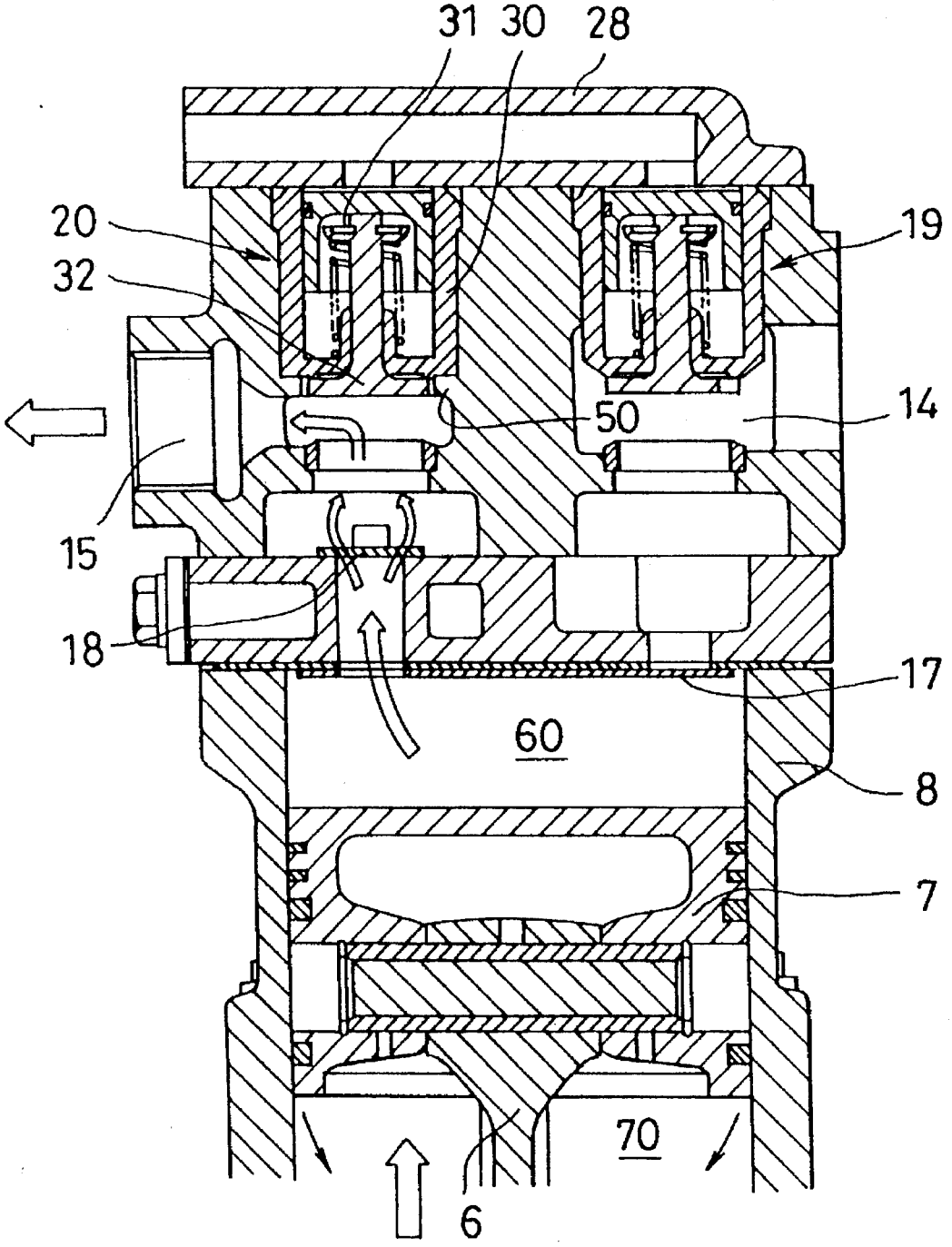
FIG. 3 is a cross section illustrating the process of the piston up-stroke during a load of the air compressor shown in FIG. 1.

In the air compressor 1 structured as described above, when the air pressure in the air tank 2 is below a specific level, as shown in FIGS. 2 and 3, the governor 5 is in a closed state. This means that compressed air is not supplied to the intake-side unloader valve 19 or to the outlet-side unloader valve 20 and that the air compression function of the compressor is in progress with the reciprocal motion of the piston 7 while the intake passage 14 and the outlet passage 15 are in an open state (load).

In other words, during the down-stroke process of the piston 7, as shown in FIG. 2 (the intake process), the volumetric capacity of the compression space 60 increases and the pressure in the compression space becomes negative. As a result, when the outlet valve 18 closes, the intake valve 16 opens so that air flows into the compression space 60 via the intake passage 14. Then, during the up-stroke process of the piston 7 shown in FIG. 3 (the compression / discharge process), the volumetric capacity of the compression space 60 becomes reduced to increase the pressure inside. The intake valve 17 is closed and, at the same time, the outlet valve 18 is opened, to supply air to the air dryer 3 via the outlet passage 15. At this point, the valve body 32 of the outlet-side unloader valve 20 is housed in the seat portion 50 formed in the cylinder head 11 and is seated on the lower side surface of the holder 30 to cut off the unload piston 31 side from the outlet passage 15.

With this, substances such as oil and carbon contained in the air which is discharged are prevented from entering the area where the unload piston 31 is in contact with the holder 30, thus preventing operational failure in the sliding area. Moreover, the valve body is prevented from making a fluttering movement due to a pressure wave or flow of the outlet air which occurs when air is let out through the outlet valve causing the valve to become worn.

Figure 4:
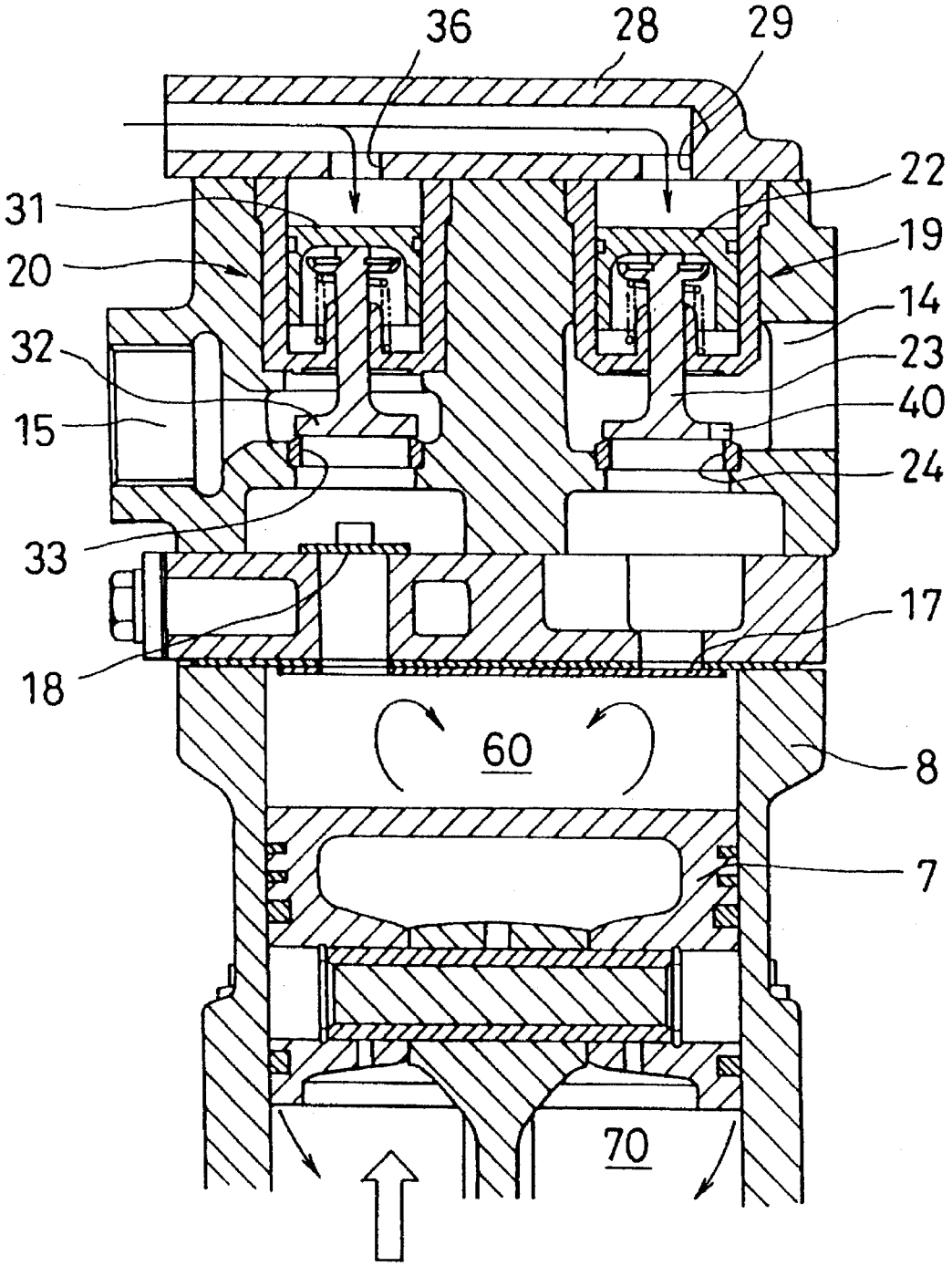
FIG. 4 is a cross section illustrating the process of the piston up-stroke during an unload of the air compressor shown in FIG. 1.
Figure 5:
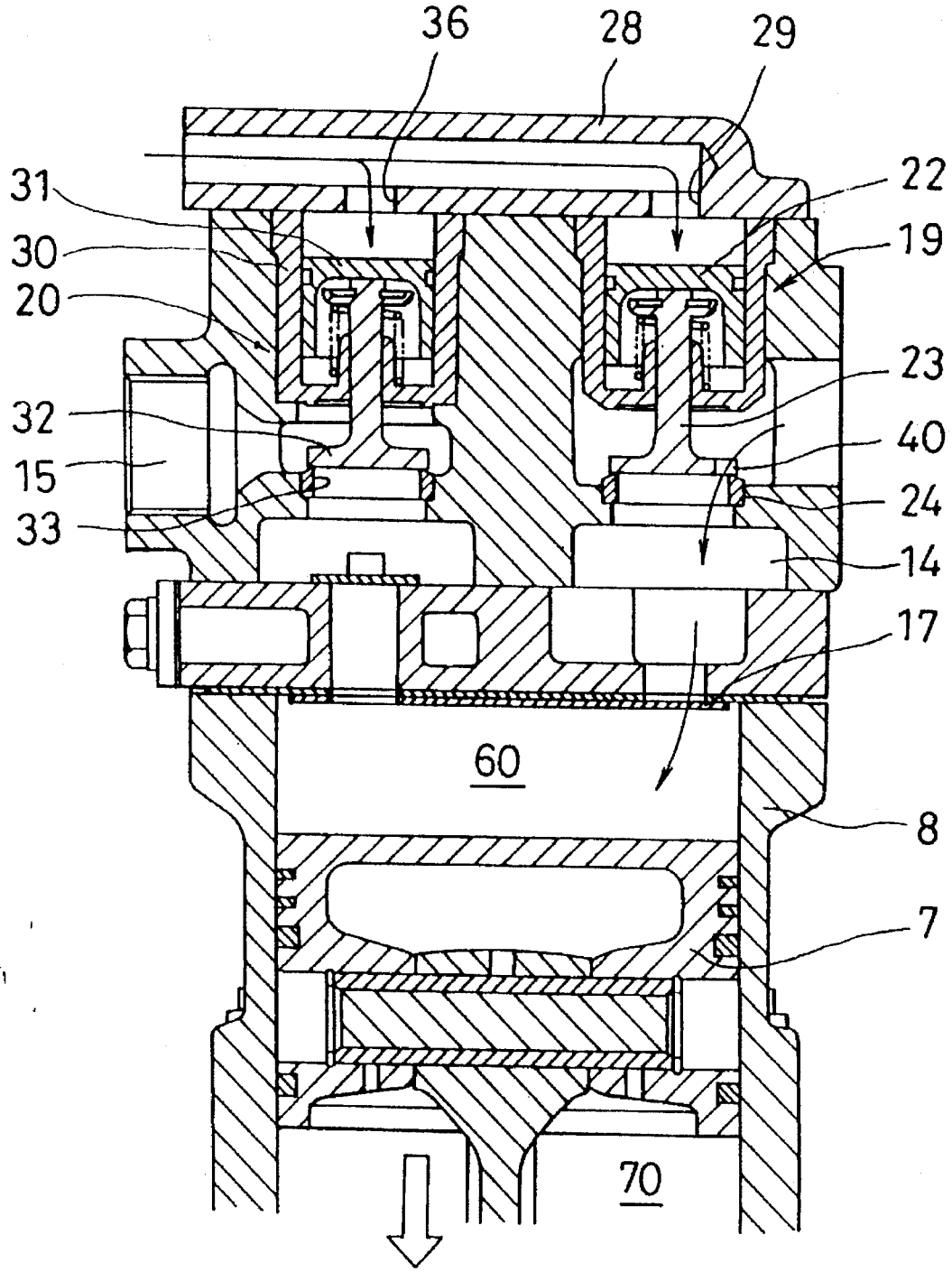
FIG. 5 is a cross section illustrating the process of the piston down-stroke during an unload of the air compressor shown in FIG. 1.

In contrast, when the air pressure in the air tank 2 exceeds a specific level, as shown in FIGS. 4 and 5, the governor 5 enters an open state and compressed air is sent from the piping 28 through the holes 29 and 36 to the intake-side unloader valve 19 and the outlet-side unloader valve 20 so that the unload pistons 22 and 31 are pressed down against the resistance of the springs 27 and 35 respectively, to seat the valve bodies 23 and 32 in the valve seats 24 and 33 respectively (unload). In this condition, the outlet passage 15 is completely blocked off and the intake passage 14 is in communication only through the air leak hole 40.

When the piston 7 is in the up-stroke process (compression process) during an unload operation, as shown in FIG. 4, the residual air in the compression space 60 is compressed and would be discharged through the outlet valve 18. However, since the outlet passage 15 is blocked off by the outlet-side unloader valve 20, this air is not let out, instead, it is compressed within the compression space 60. During this compression process, since the pressure in the compression space 60 becomes high, a small quantity of the air in the compression space 60 leaks out as blow-by through the gap between the piston 7 and the cylinder 8 toward the crank chamber 70. Consequently, the compressed air pressure of the residual air becomes gradually lowered to a specific level. Note that in order to prevent the pressure in the compression space 60 from being applied to the intake valve 17 in its entirety, the intake-side unloader valve 9 blocks off the intake passage 14.

Also, during the down-stroke process of the piston 7 (leak-air intake process), as shown in FIG. 5, if the pressure in the compression space 60 drops under a specific level due to the blow-by during the compression process described above, a specific quantity of air is taken in to the compression space 60 through the air leak hole 40 for replenishment. Thus, the quantity of air being compressed in the compression space 60 is maintained constant at all times. Because of this, even when the unload time is long, the pressure in the compression space 60 is prevented from becoming negative due to the blow by and oil loss can be prevented on the crank chamber 70 side.

Note that if the intake-side unloader valve 19 is not provided with an air leak hole, then when it is opened during the leak-air intake process described earlier, a specific quantity of air is taken in from the intake passage 14 to be compressed, as in the case of a load operation. This will result in the air pressure in the compression space 60 exceeding a specific level. Consequently, the valve body 32 of the outlet-side unloader valve 20 is pressed upward to discharge air. In order to prevent this, if the closing force of the unloader valve 20 is increased, the pressure in the compression space will also increase, reaching approximately 30–40 Kgwt/cm$^2$ with the piston at the top dead center. This increases the drive peak torque, which results in an increase in the power loss at the air compressor. The air leak hole 40 is formed with a specific diameter (specific passage resistance) in the unloader valve 19 to solve this problem. Note that while in this embodiment the air leak hole 40 is formed in the valve body 23 of the unloader valve 19, similar advantages can be achieved with an air leak hole formed on the valve seat 24 side.

As has been explained, according to the present invention, since an air leak hole with a specific level of ventilating resistance is formed between the valve body of the intake-side unloader valve and the valve seat when the intake-side unloader valve is closed, the quantity of air that blows by during the compression process in an unload operation can be replenished by taking air into the compression space through the air leak hole, thus preventing oil loss into the compression space.

Furthermore, since the seat portion is provided for housing the valve body of the outlet-side unloader valve to cut off the sliding portion of the outlet-side unloader valve from the outlet passage when the outlet-side unloader valve is open, oil, carbon and the like are prevented from adhering to the sliding portion of the outlet-side unloader valve during a load. Thus, operational failure in the sliding portion is prevented. At the same time, the valve body is prevented from becoming worn due to a fluttering movement caused by a pressure wave or flow of the outlet air, thereby achieving stabilization of operation of the outlet-side unloader valve and also increasing its service life.

What is claimed is:

1. An air compressor comprising:

a cylinder;

a piston slidably mounted in said cylinder;

a cylinder head mounted on said cylinder, said cylinder head defining an air inlet passage and an air outlet passage;

an inlet valve positioned between said cylinder and said air inlet passage to permit air to flow from said air inlet passage into said cylinder in response to movement of said piston in a first direction;

an outlet valve positioned between said cylinder and said air outlet passage to permit air to flow from said cylinder into said outlet passage in response to movement of said piston in a second direction;

an inlet-side unloader valve having a valve body and a valve seat, said inlet-side unloader valve being mounted in said cylinder head and being operable to close said air inlet passage;

an outlet-side unloader valve mounted in said cylinder head; and an air leak hole having a specific ventilating resistance and being formed in one of said valve body and said valve seat of said inlet-side unloader valve.

2. The air compressor as claimed in claim 1, further comprising an air conduit attached to said cylinder head for communicating with a governor connected in parallel with an air tank, an air dryer, and a check valve.

3. The air compressor as claimed in claim 2, wherein said air conduit is in communication with said inlet-side unloader valve and said outlet-side unloader valve to permit communication with a discharge side of the governor.

4. The air compressor as claimed in claim 2, wherein said inlet-side unloader valve and said outlet-side unloader valve are capable of operating in response to pressure from the governor when pressure in the air tank exceeds a predetermined level.

5. The air compressor as claimed in claim 3, wherein said inlet-side unloader valve and said outlet-side unloader valve are capable of operating in response to pressure from the governor when pressure in the air tank exceeds a predetermined level.

6. An air compressor comprising:

a hollow cylinder having a first end and a second end;

a piston slidably mounted in said cylinder to form a compression chamber;

a cylinder head mounted on a first end of said cylinder, said cylinder head defining an air inlet passage and an air outlet passage;

an inlet valve positioned between said inlet passage and said compression chamber to permit air to flow into said compression chamber;

an outlet valve positioned between said outlet passage and said compression chamber to permit air to flow from said compression chamber;

an inlet-side unloader valve mounted in said cylinder head adjacent said inlet passage, said inlet-side unloader valve including a holder, an inlet-side unloader piston slidably fitted in said holder, and a valve body slidably mounted in said holder and engaging said piston;

an outlet-side unloader valve mounted in said cylinder head adjacent said outlet passage, said outlet-side unloader valve including an outlet-side holder forming an interior space, an outlet-side piston slidably fitted in said holder, and a valve body slidably connected to said holder for blocking said outlet passage; and a valve seat portion extending between one end of said outlet-side holder and said discharge passage, said valve seat portion forming a recess for receiving said valve body of said outlet-side unloader valve when said outlet-side unloader valve is in an open position, wherein said valve body of said outlet side unloader valve isolates said interior space of said holder from said discharge passage when said valve body of said outlet side unloader valve is received in said recess formed by said valve seat portion.

7. The air compressor as claimed in claim 6, further comprising an air conduit attached to said cylinder head for communicating with a governor connected in parallel with an air tank, an air dryer, and a check valve.

8. The air compressor as claimed in claim 7, wherein said air conduit is in communication with said inlet-side unloader valve and said outlet-side unloader valve to permit communication with a discharge side of the governor.

9. The air compressor as claimed in claim 8, wherein said inlet-side unloader valve and said outlet-side unloader valve are capable of operating in response to pressure from the governor when pressure in the air tank exceeds a predetermined level.

10. The air compressor as claimed in claim 7, wherein said inlet-side unloader valve and said outlet-side unloader valve are capable of operating in response to pressure from the governor when pressure in the air tank exceeds a predetermined level.

11. An air compressor comprising:

a cylinder;

a piston slidably positioned in said cylinder;

a cylinder head defining an air inlet passage and an air outlet passage;

an inlet valve located between said air inlet passage and said cylinder;

an outlet valve located between said cylinder and said air outlet passage;

an inlet-side unloader valve being mounted in said cylinder head, said inlet-side unloader valve having a valve seat and a valve body for blocking said air inlet passage in a closed position of said inlet-side unloader valve;

an outlet-side unloader valve having a valve body for blocking said air outlet passage;

an air leak hole having a specific ventilating resistance and being formed in one of said valve body and said valve seat to permit limited air flow to said cylinder when said inlet-side unloader valve blocks said inlet passage; and a seat portion forming a recess for housing said valve body of said outlet-side unloader valve when said outlet-side unloader valve is in an open position.

12. The air compressor as claimed in claim 11, further comprising an air conduit attached to said cylinder head for communicating with a governor connected in parallel with an air tank, an air dryer, and a check valve.

13. The air compressor as claimed in claim 12, wherein said air conduit is in communication with said inlet-side unloader valve and said outlet-side unloader valve to permit communication with a discharge side of the governor.

14. The air compressor as claimed in claim 13, wherein said inlet-side unloader valve and said outlet-side unloader valve are operable in response to pressure from the governor when pressure in the air tank exceeds a predetermined level.

15. The air compressor as claimed in claim 12, wherein said inlet-side unloader valve and said outlet-side unloader valve are operable in response to pressure from the governor when pressure in the air tank exceeds a predetermined level.

* * * * *